US008042514B2

(12) United States Patent
Arnold et al.

(10) Patent No.: US 8,042,514 B2
(45) Date of Patent: Oct. 25, 2011

(54) THROTTLE BODIES AND SADDLE-TYPE VEHICLES INCLUDING VALVED INTAKE CONDUITS FOR ENGINE

(75) Inventors: David W. Arnold, Glendale, CA (US); Michael Bury, Temecula, CA (US)

(73) Assignee: Honda Motor Company, Ltd., Tokyo (JP)

( * ) Notice: Subject to any disclaimer, the term of this patent is extended or adjusted under 35 U.S.C. 154(b) by 75 days.

(21) Appl. No.: 12/178,835

(22) Filed: Jul. 24, 2008

(65) Prior Publication Data

US 2010/0018497 A1 Jan. 28, 2010

(51) Int. Cl.
*F02D 9/10* (2006.01)

(52) U.S. Cl. ..... 123/336; 123/399

(58) Field of Classification Search ..... 123/336, 123/337, 399, 396, 400, 478, 403, 442, 583; 180/170, 219; 215/305
See application file for complete search history.

(56) References Cited

U.S. PATENT DOCUMENTS

| | | | | |
|---|---|---|---|---|
| 1,799,426 | A | 4/1931 | Lang et al. | |
| 4,200,083 | A * | 4/1980 | Ishida | 123/198 F |
| 4,491,106 | A | 1/1985 | Morris | |
| 4,633,833 | A | 1/1987 | Morris | |
| 4,691,670 | A | 9/1987 | Bonisch et al. | |
| 4,817,374 | A * | 4/1989 | Kitta | 60/313 |
| 5,095,871 | A * | 3/1992 | Mezger | 123/198 C |
| 5,778,851 | A | 7/1998 | Schellhase et al. | |
| 5,845,677 | A * | 12/1998 | Kim | 137/595 |
| 6,189,505 | B1 | 2/2001 | Reid | |
| 6,347,787 | B1 * | 2/2002 | Tobinai et al. | 261/23.3 |
| 6,478,011 | B2 | 11/2002 | Paffrath | |
| 6,543,401 | B2 * | 4/2003 | Trease | 123/90.31 |
| 6,591,794 | B2 * | 7/2003 | Toda | 123/73 A |
| 6,712,040 | B1 | 3/2004 | Giffin | |
| 6,745,739 | B2 * | 6/2004 | Fujihira et al. | 123/184.21 |
| 6,761,145 | B2 | 7/2004 | Matsuda et al. | |
| 6,910,546 | B2 * | 6/2005 | Tsutsumi et al. | 180/219 |
| 7,021,264 | B2 * | 4/2006 | Giffin | 123/184.55 |
| 7,168,517 | B2 * | 1/2007 | Udono | 180/219 |
| 7,543,563 | B2 * | 6/2009 | Dunn | 123/399 |
| 2004/0231626 | A1 * | 11/2004 | Trease | 123/90.39 |
| 2005/0155571 | A1 | 7/2005 | Hanasato | |
| 2006/0231069 | A1 * | 10/2006 | Hanasato | 123/336 |
| 2008/0216794 | A1 * | 9/2008 | Kuji et al. | 123/336 |
| 2008/0230034 | A1 * | 9/2008 | Dunn | 123/336 |
| 2009/0095254 | A1 * | 4/2009 | Yamada | 123/337 |

* cited by examiner

*Primary Examiner* — Willis Wolfe, Jr.
*Assistant Examiner* — Johnny H Hoang
(74) *Attorney, Agent, or Firm* — Ulmer & Berne LLP

(57) ABSTRACT

A throttle body includes first and second intake conduits, first and second valves, and first and second gears. The first and second intake conduits are configured for respective placement in fluid communication with first and second cylinder housings of an engine. The first valve is associated with the first intake conduit and is movable to selectively adjust restriction of the first intake conduit to passage of fluid. The second valve is associated with the second intake conduit and is movable to selectively adjust restriction of the second intake conduit to passage of fluid. The first gear is attached to the first valve and the second gear attached to the second valve. The second gear is engaged with the first gear such that the first and second gears correspondingly rotate. Engines and saddle-type vehicles are also provided.

25 Claims, 6 Drawing Sheets

THROTTLE BODIES AND SADDLE-TYPE VEHICLES INCLUDING VALVED INTAKE CONDUITS FOR ENGINE

TECHNICAL FIELD

Gear driven valves are associated with respective intake conduits for an engine for selectively adjusting restriction of the intake conduits to passage of fluid to the engine.

BACKGROUND

A conventional vehicle includes an engine and a throttle body provided in the schematic arrangement of FIG. 6. In particular, a V-twin engine includes first and second cylinders 119 and 121 which are arranged in a V-shape for receiving respective pistons. First and second intake conduits 124 and 128 are provided in respective communication with the first and second cylinders 119 and 121 to facilitate passage of fluid (e.g., ambient air) through respective passageways 126 and 130 and into the respective cylinders 119 and 121. Rotatable butterfly-type valves 150 and 152 are respectively provided in each of the passageways 126 and 130 to facilitate selective restriction of fluid flow to the cylinders 119 and 121. A linkage member 199 is attached to the butterfly-type valves 150, 152 in order that the butterfly-type valves 150, 152 pivot in correspondence with one another. A Bowden-type cable is then attached to a throttle control device and to one of the butterfly-type valves 150, 152 so that both of the butterfly-type valves 150, 152 can be controlled by the throttle control device.

SUMMARY

In accordance with one embodiment, an engine comprises a first cylinder housing, a second cylinder housing, a first intake conduit, a second intake conduit, a first valve, a first gear, a second valve, a second gear, and an actuation member. The first cylinder housing and the second cylinder housing are arranged in a V-shape. The first intake conduit is in fluid communication with the first cylinder housing. The second intake conduit is in fluid communication with the second cylinder housing. The first valve is associated with the first intake conduit and is movable to selectively adjust restriction of the first intake conduit to passage of fluid. The first gear is attached to the first valve. The second valve is associated with the second intake conduit and is movable to selectively adjust restriction of the second intake conduit to passage of fluid. The second gear is attached to the second valve and is engaged with the first gear such that the first gear and the second gear correspondingly rotate. The actuation member is engaged with at least one of the first gear and the second gear and is configured to facilitate movement of each of the first valve and the second valve.

In accordance with another embodiment, a saddle-type vehicle comprises an engine, a first intake conduit a second intake conduit, a first-valve, a first gear, a second valve, a second gear, and an actuator. The engine comprises a first cylinder housing and a second cylinder housing. The first intake conduit is in fluid communication with the first cylinder housing. The second intake conduit is in fluid communication with the second cylinder housing. The first valve is associated with the first intake conduit and is movable to selectively adjust restriction of the first intake conduit to passage of fluid. The first gear is attached to the first valve. The second valve is associated with the second intake conduit and is movable to selectively adjust restriction of the second intake conduit to passage of fluid. The second gear is attached to the second valve and is engaged with the first gear such that the first gear and the second gear correspondingly rotate. The actuator is engaged with at least one of the first gear and the second gear and is configured to facilitate movement of each of the first valve and the second valve.

In accordance with yet another embodiment, a throttle body comprises a first intake conduit, a second intake conduit, a first valve, a first gear, a second valve, and a second gear. The first intake conduit is configured for placement in fluid communication with a first cylinder housing of an engine. The second intake conduit is configured for placement in fluid communication with a second cylinder housing of an engine. The first intake conduit and the second intake conduit are arranged in a V-shape. The first valve is associated with the first intake conduit and is movable to selectively adjust restriction of the first intake conduit to passage of fluid. The first gear is attached to the first valve. The second valve is associated with the second intake conduit and is movable to selectively adjust restriction of the second intake conduit to passage of fluid. The second gear is attached to the second valve and is engaged with the first gear such that the first gear and the second gear correspondingly rotate.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION

The present invention and its operation are hereinafter described in detail in connection with the views and examples of FIGS. 1-5. A motorcycle 10 is shown to comprise wheels 14 and a seat 16. The seat 16 is shown to be disposed at a location vertically above an engine 12. The engine 12 may transmit power to at least one of the wheels 14 (i.e., through a drivetrain) to facilitate propulsion of the motorcycle 10.

Figure 1:
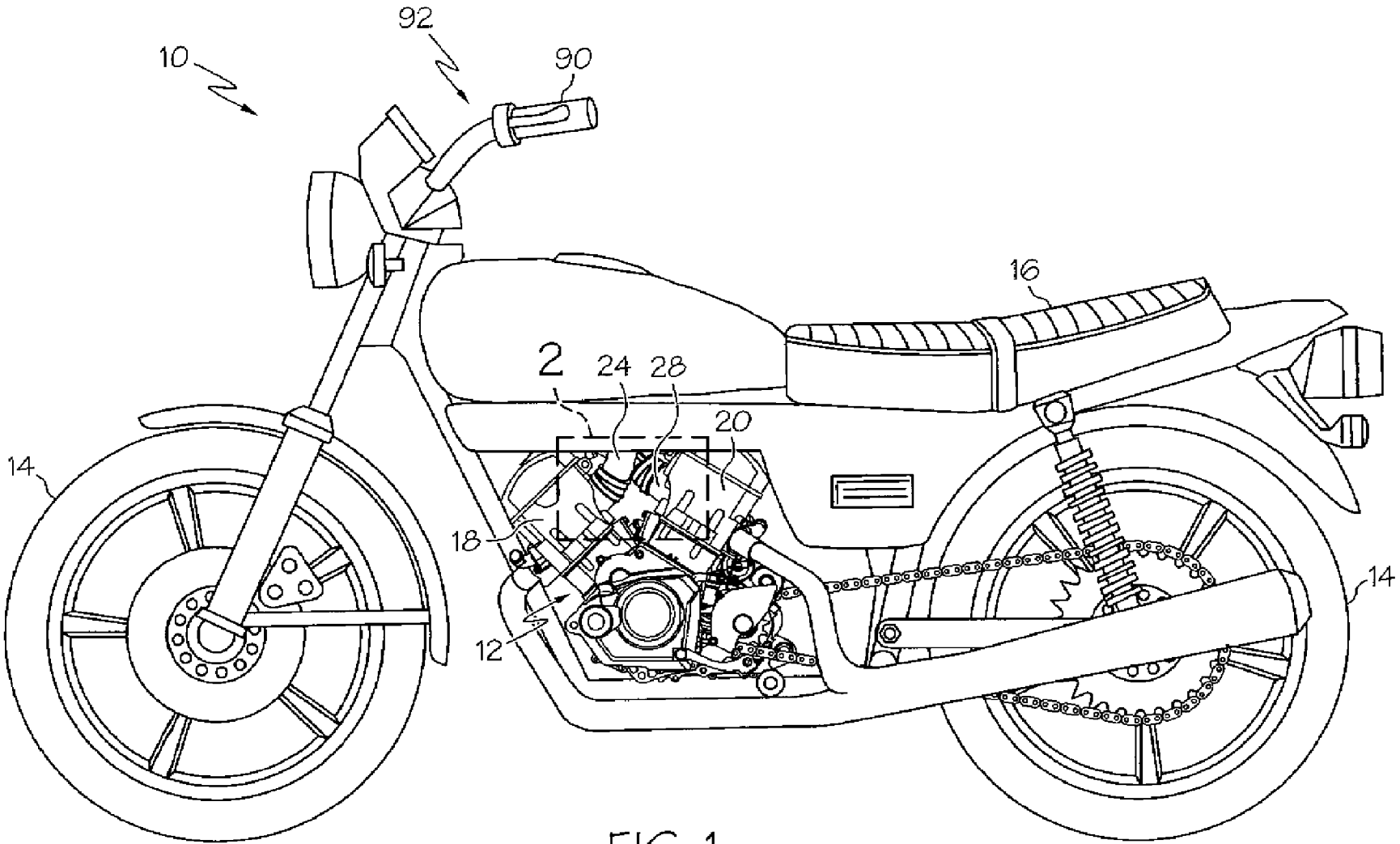
FIG. 1 is a left side elevational view depicting a motorcycle in accordance with one embodiment.
Figure 3:
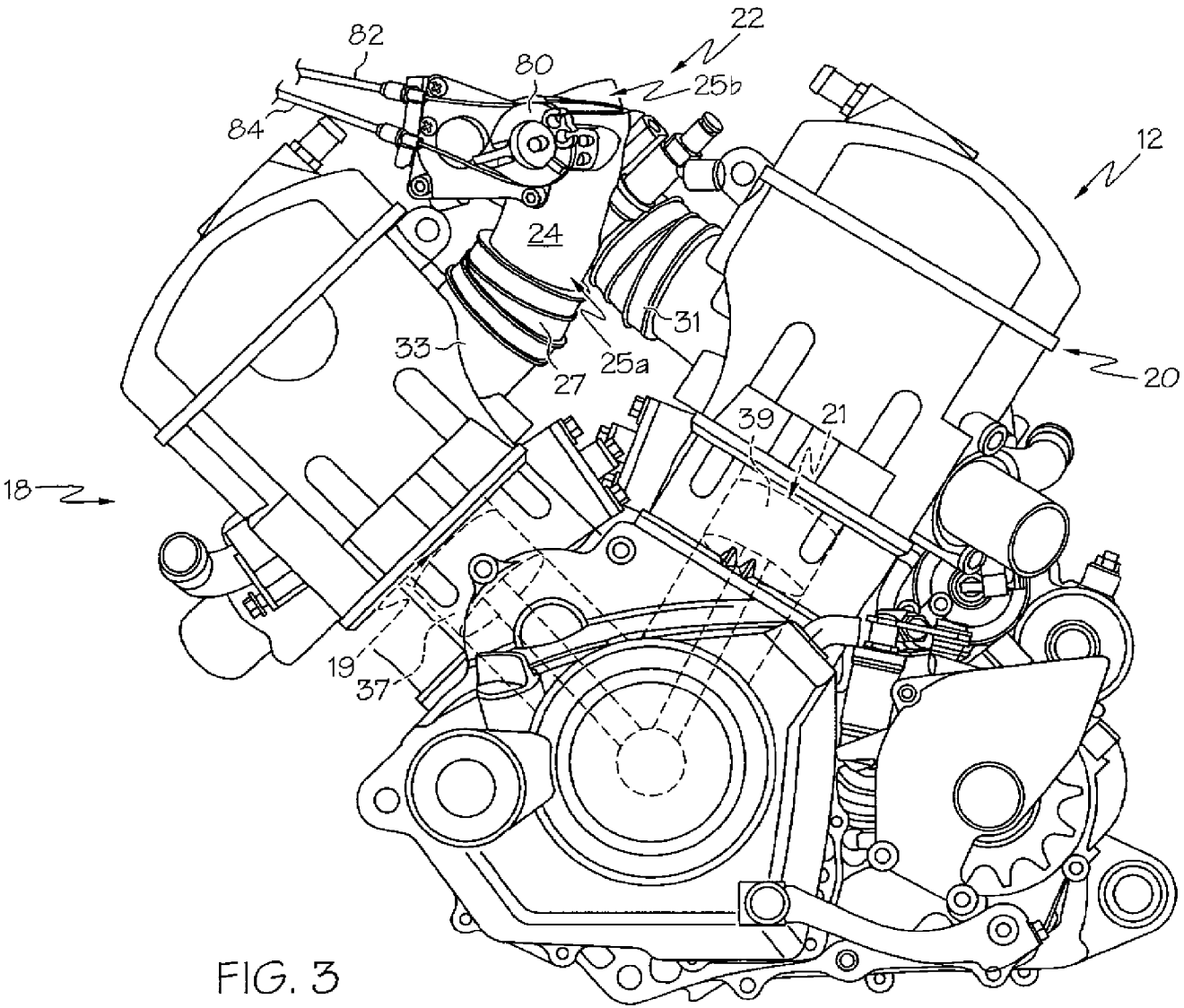
FIG. 3 is a left side elevational view depicting certain components of the motorcycle of FIG. 1 apart from the remaining components of the motorcycle for clarity of illustration.

An engine may comprise a cylinder housing that defines one or more cylinders for slidably receiving pistons which are engaged with a crankshaft of the engine. In one embodiment, and as illustrated in FIG. 1, the engine 12 may comprise a V-twin engine. In such an embodiment, the engine 12 may comprise a first cylinder housing 18 and a second cylinder housing 20. As shown in FIG. 3, the first cylinder housing 18 may define at least a portion of a first cylinder 19 and the second cylinder housing 20 may define at least a portion of a second cylinder 21. A first piston 37 and a second piston 39 may be at least partially disposed within the first cylinder 19 and the second cylinder 21, respectively. The first and second cylinders 19, 21 and corresponding first and second pistons 37, 39 may be arranged in a V-shape such that at least a portion of each of the first cylinder housing 18 and the second cylinder housing 20 are also arranged in a V-shape. The first and second pistons 37, 39 may be engaged with a crankshaft such that actuation of the first and second pistons 37, 39 correspondingly rotates the crankshaft to facilitate propulsion of the motorcycle 10. In another embodiment, the engine may comprise an L-twin engine. In such an embodiment, the engine may comprise a first cylinder housing and a second cylinder housing which are arranged in an L-shape and which define respective cylinders which are also arranged in an L-shape. While the engine 12 is shown to comprise a V-twin engine, meaning that the engine is a V-type engine having only two pistons, it will be appreciated that a vehicle in accordance with an alternative embodiment can comprise an engine such as, for example, a single cylinder engine, a multi-cylinder non-V-type engine, or a multi-cylinder V-type engine having more than two pistons.

Figure 2:
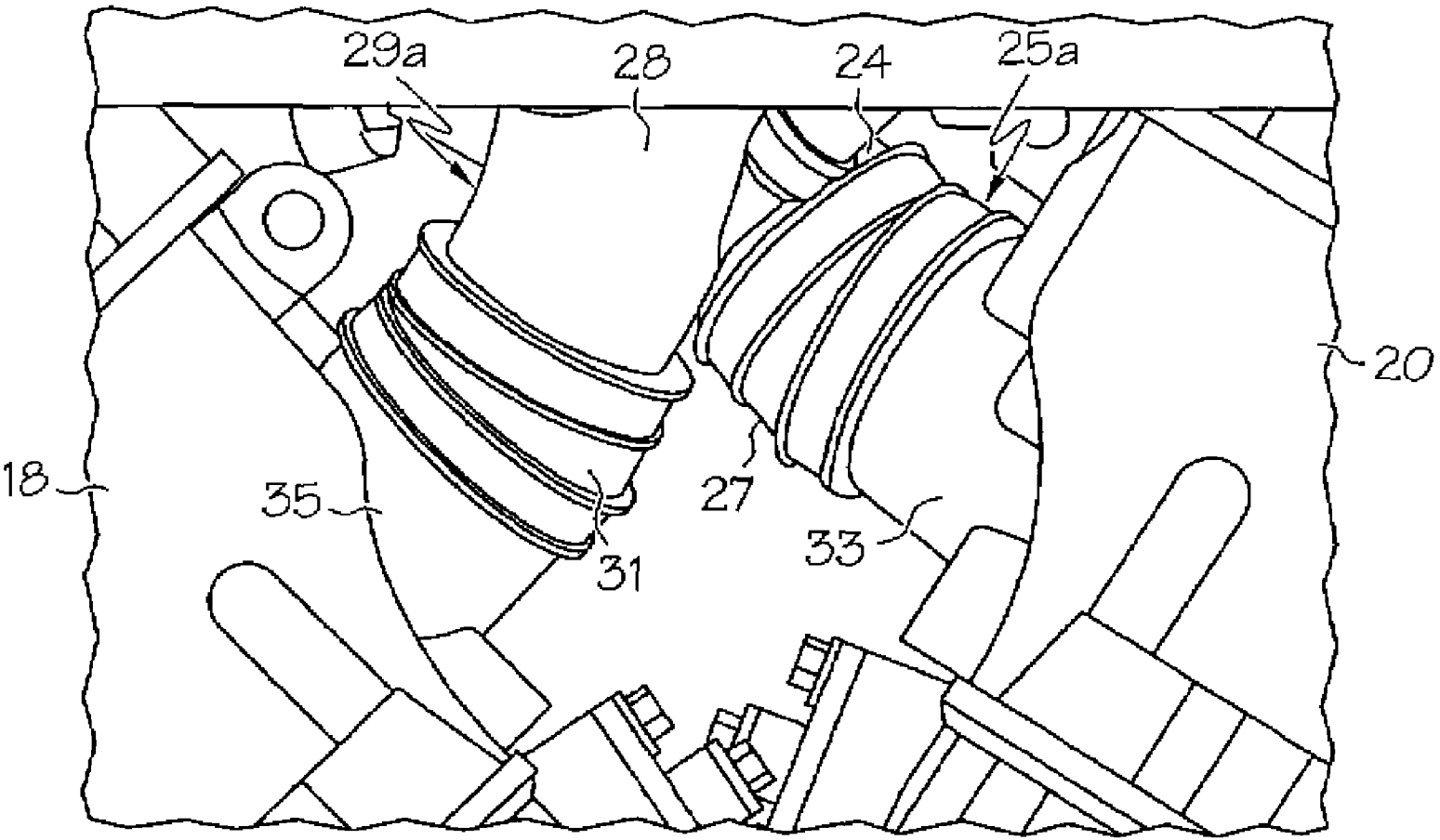
FIG. 2 is an enlargement of a portion of FIG. 1.

As is common, a piston of an engine may be actuated through combustion of fluid (e.g., by a spark plug or via compression) that is provided to a corresponding cylinder. The fluid may comprise ignition fluid (e.g., gasoline, diesel fuel, propane), ambient air, a mixture of ignition fluid and ambient air, and/or any other combustible fluid. Accordingly, a cylinder housing may define at least one opening to facilitate the introduction of such fluid into a cylinder. In one embodiment, and as illustrated in FIGS. 2 and 3, the first cylinder housing 18 may define a first intake port 33. The first intake port 33 may be in fluid communication with the first cylinder 19. Fluid passed to the first intake port 33 may be directly introduced to the first cylinder 19, or may alternatively be indirectly introduced to the first cylinder 19 such as through the use of an intake valve disposed within the first cylinder housing 18. In another embodiment, the first cylinder housing may comprise a first intake manifold attached (e.g., with bolts) to the first cylinder. The first intake manifold may define a first intake port in fluid communication with the first cylinder such that fluid may be provided to the first intake port, through the intake manifold, and into the first cylinder. It will be appreciated that the first cylinder housing may be configured in any of a variety of other configurations to facilitate fluid communication with the first cylinder. It will also be appreciated that the engine may comprise a second cylinder housing 20 provided in a similar arrangement to the first cylinder housing 18. In particular, the second cylinder housing 20 may define a second intake port 35 that is in fluid communication with the second cylinder 21.

Figure 4:
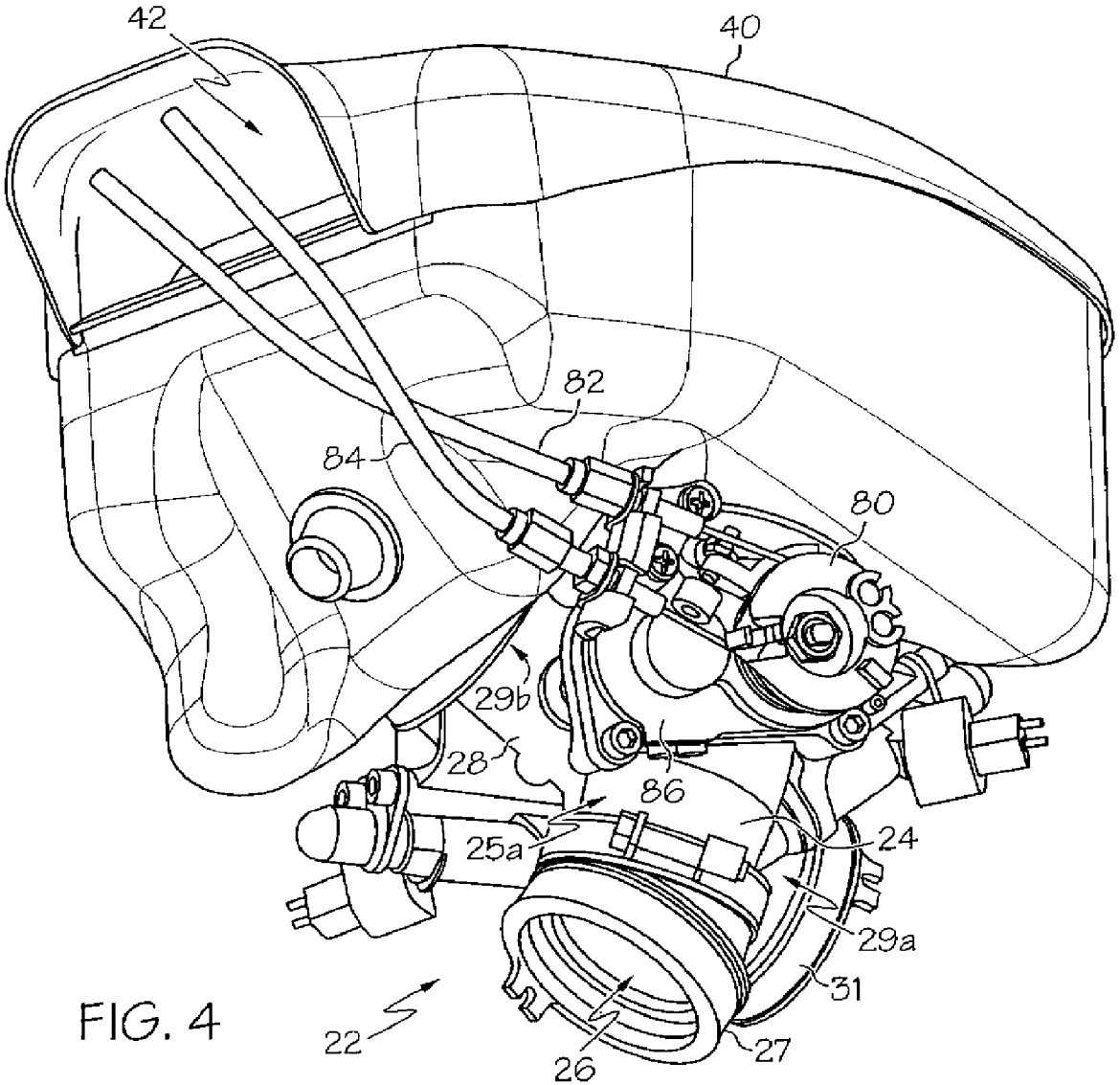
FIG. 4 is a left lower perspective view depicting a throttle body in fluid communication with an air box of the motorcycle of FIG. 1, wherein the throttle body and the air box have been removed from the motorcycle for clarity of illustration.
Figure 5:
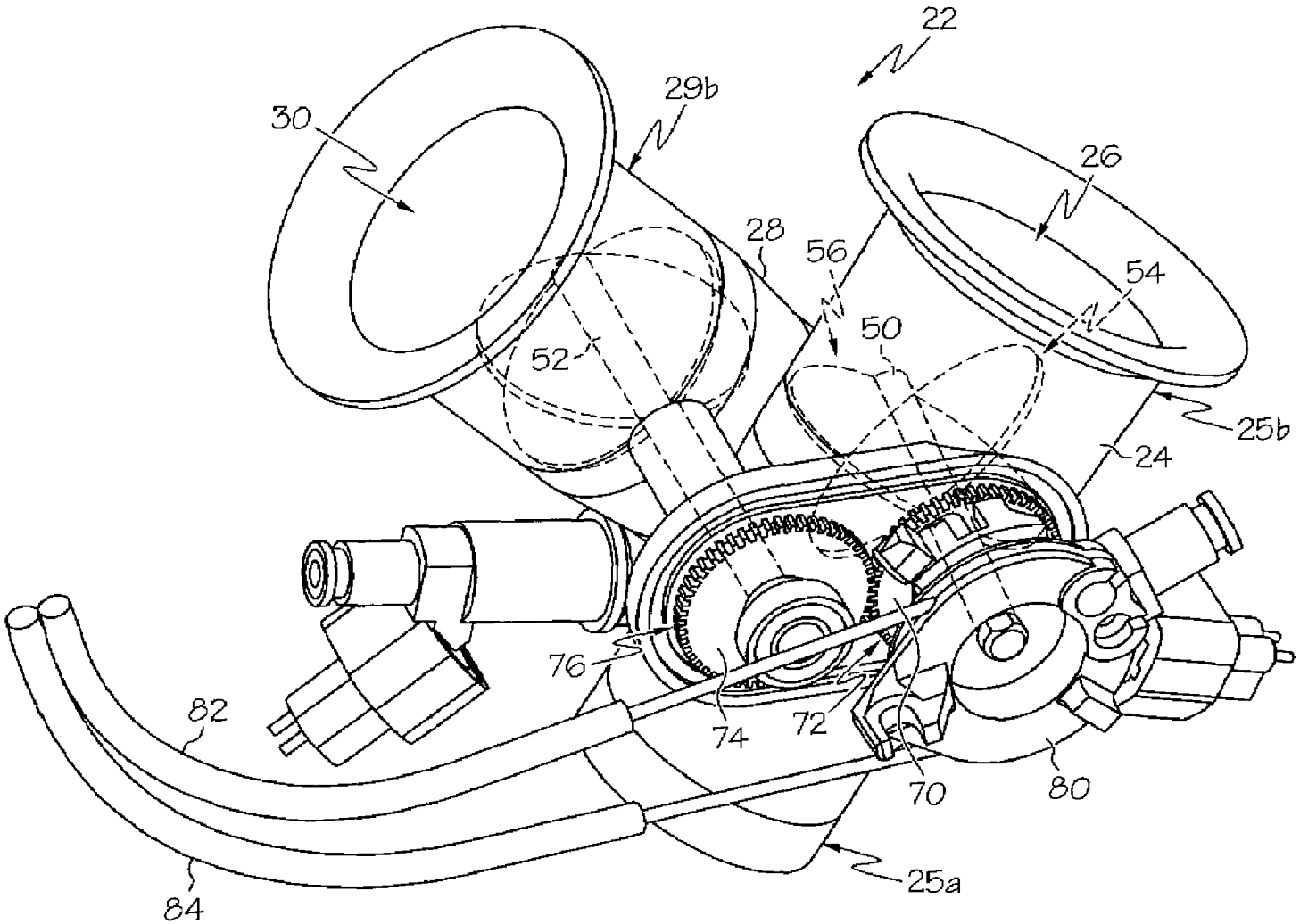
FIG. 5 is a left upper perspective view depicting certain components of the throttle body of FIG. 4 apart from the other components of FIG. 4 for clarity of illustration.

The engine may comprise a throttle body having a plurality of intake conduits. The intake conduits may be configured for placement in fluid communication with the cylinder housings to facilitate the introduction of combustible fluid into the cylinders. For example, and as shown in FIGS. 3-5, the engine 12 may comprise a throttle body 22 having a first intake conduit 24 and a second intake conduit 28. The first intake conduit 24 is shown to comprise an elongated tubular member which extends between a first end 25*a* and a second end 25*b* and which defines a first passageway 26. Likewise, the second intake conduit 28 is shown to comprise an elongated tubular member which extends between a first end 29*a* and a second end 29*b* and which defines a second passageway 30. In one embodiment, as shown in FIGS. 3-5, the first and second intake conduits 24, 28 can comprise annular members and the first and second passageways 26, 30 can be cylindrical. It will be appreciated that the intake conduits may have any of a variety of configurations which can be suitable to facilitate their placement in fluid communication with respective cylinder housings of an engine.

Intake conduits of a throttle body may be placed in fluid communication with cylinder housings in any of a variety of suitable configurations such that fluid (e.g., ambient air) may be provided through the intake conduits, into the cylinder housings, and into the cylinders. For example, and as illustrated in FIGS. 2 and 3, the first end 25*a* of the first intake conduit 24 may be connected to the first intake port 33 defined by the first cylinder housing 18. In such an embodiment, fluid may be provided through the first passageway 26 of the first intake conduit 24 and into the first intake port 33 defined by the first cylinder housing 18. The fluid may accordingly pass to the first cylinder 19 to facilitate combustion within the first cylinder 19. The second intake conduit 28 may similarly be provided in fluid communication with the second cylinder housing 20. In particular, the first end 29*a* of the second intake conduit 28 may be connected with the second intake port 35 defined by the second cylinder housing 20. In such an embodiment, fluid may be provided through the second passageway 30 of the second intake conduit 28 and into the second intake port 35 defined by the second cylinder housing 20. The fluid may accordingly pass to the second cylinder 21 to facilitate combustion within the second cylinder 21. In another embodiment, first ends of the first and second intake conduits may respectively communicate with first and second intake ports defined by first and second intake manifolds. In such an embodiment, fluid may pass through respective passageways in the first and second intake conduits, into the first and second intake manifolds, and into the first and second cylinder housings to facilitate combustion within the first and second cylinders. It will be appreciated that intake conduits of a throttle body may be provided in fluid communication with respective cylinder housings in any of a variety of alternative configurations or arrangements.

The first end 25*a* of the first conduit 24 is shown in FIGS. 2-4 to be attached to the first intake port 33 through use of a first coupling 27. Likewise, the first end 29*a* of the second conduit 28 is shown in FIGS. 2-4 be attached to the second intake port 35 through use of a second coupling 31. In one embodiment, each of the first and second couplings 27 and 31 can be formed from a resilient material such as may comprise rubber. However, it will be appreciated that the conduits of a throttle body may interact with intake ports or other portions of an engine in any of a variety of other configurations or arrangements. For example, an end of an intake conduit may be heat welded to an intake port of an engine. In another example, an end of an intake conduit may be threadably engaged with an intake port of an engine. In yet another example, an end of an intake conduit may be disposed adjacent to an intake port of an engine in an interference fit or with no physical connection whatsoever.

The second ends 25*b* and 29*b* of the first and second intake conduits 24, 28 are shown in FIG. 4 to be in fluid communication with an air box 40. The air box 40 can be configured to facilitate the removal of particulates (e.g., dust, insects, leaves) from ambient air passing into the first and second intake conduits 24, 28. In one embodiment, ambient air can enter the air box 40 through an opening 42 in the air box 40, can pass through one or more filters disposed in the air box 40, and can enter into the intake conduits 24, 28. However, it will be appreciated that this removal of particulates from ambient air may be alternatively achieved through the use of other arrangements. It will also be appreciated that fluid may be provided to conduits of a throttle body without use of an air box 40 or any other intake or filtration arrangement.

The first intake conduit 24 and the second intake conduit 28 are shown in FIGS. 3-5 as being arranged in a V-shape. In this configuration, it will be appreciated that the first and second intake conduits 24, 28 can readily align with respective intake ports (e.g., 33, 35) of a V-twin engine (e.g., 12), for example. However, it will be appreciated that intake conduits of a throttle body can alternatively be arranged in any of a variety of other suitable configurations. For example, respective intake conduits of a throttle body may be substantially parallel with each other or might alternatively be substantially perpendicular to each other.

When adjusting operating characteristics of an engine (e.g., increasing/decreasing the frequency of piston actuation), it may be desirable to selectively adjust the volume of fluid which flows through the intake conduits of a throttle body to cylinder housings of the engine. To facilitate such selective adjustment, the throttle body may comprise one or more valves associated with the intake conduit(s). In one embodiment, and as illustrated in FIG. 5, the throttle body 22 may comprise a first valve 50 and a second valve 52. Each of the first and second valves 50, 52 are shown to comprise a butterfly-type valve. The first valve 50 is shown to be disposed in the first passageway 26 of the first intake conduit 24. The first valve 50 may be pivotable with respect to the first intake conduit 24 among a range of positions. For example, in a first position (identified as "54"), the first valve 50 is shown to only minimally restrict the passage of fluid through the passageway 26. As another example, in a second position (identified as "56"), the first valve 50 is shown to substantially restrict the passage of fluid through the passageway 26. The selective restriction of the passage of fluid through the first intake conduit 24 by the first valve 50 can accordingly be achieved by selectively pivoting the first valve 50 with respect to the first passageway 26. It will be appreciated that the second valve 52 may be configured similarly to the first valve 50 for selectively restricting flow of fluid through the second passageway 30 of the second intake conduit 28. It will also be appreciated that a valve may be provided in any of a variety of alternative configurations or arrangements for selectively adjusting an intake conduit's restriction of fluid passage.

Although the first and second valves 50, 52 are depicted in FIG. 5 to be substantially disposed in the first and second passageways 26, 30 and to be pivotable with respect to the first and second intake conduits 24, 28, it will be appreciated that a valve may be associated with an intake conduit in any of a variety of other configurations or arrangements. For example, a valve might be configured such that at least a portion of the valve may be selectively entirely removed from the passageway when in certain positions (e.g., in certain circumstances when a valve is slidable with respect to the intake conduit). As another example, a valve may comprise a louvered-type arrangement disposed at least partially within a passageway of an intake conduit.

A throttle body may comprise gears attached to each respective valve. In one embodiment, and as illustrated in FIG. 5, the throttle body 22 may comprise a first gear 70 and a second gear 74 that are rotatable with respect to the first and second conduits 24, 28. The first and second gears 70, 74 may be respectively attached to the first and second valves 50, 52. The first and second valves 50, 52 may be pivotally supported with respect to the intake conduits 24, 28 such that pivoting the first and second gears 70, 74 respectively pivots the first and second valves 50, 52 within the first and second passageways 26, 30.

The gears attached to the valve(s) may be engaged with each other to facilitate cooperative movement of the valves. In one embodiment, the first and second gears 70 and 74 can respectively include first and second sets of involute teeth 72 and 76 which are engaged together such that rotation of the first gear 70 correspondingly rotates the second gear 74 in an opposite direction. In such an embodiment, pivoting the first gear 50 can cause pivoting of the first valve 50 with respect to the first conduit 24 and can also correspondingly pivot the second gear 74 and the second valve 52 with respect to the second conduit 28. Although the first and second gears 70 and 74 are depicted as two spur gears having a gear ratio of 1:1, it will be appreciated that any of a variety of additional or alternative gear arrangements (e.g., including worm gears, helical gears, double helical gears, bevel gears, hypoid gears, crown gears, and/or a rack and pinion gear arrangement), and involving any of a variety of suitable gear ratios, may be implemented to facilitate corresponding movement of first and second valves associated with the throttle body. It will also be appreciated that gears may be attached to valves of a throttle body in any of a variety of suitable configurations or arrangements.

Figure 6:
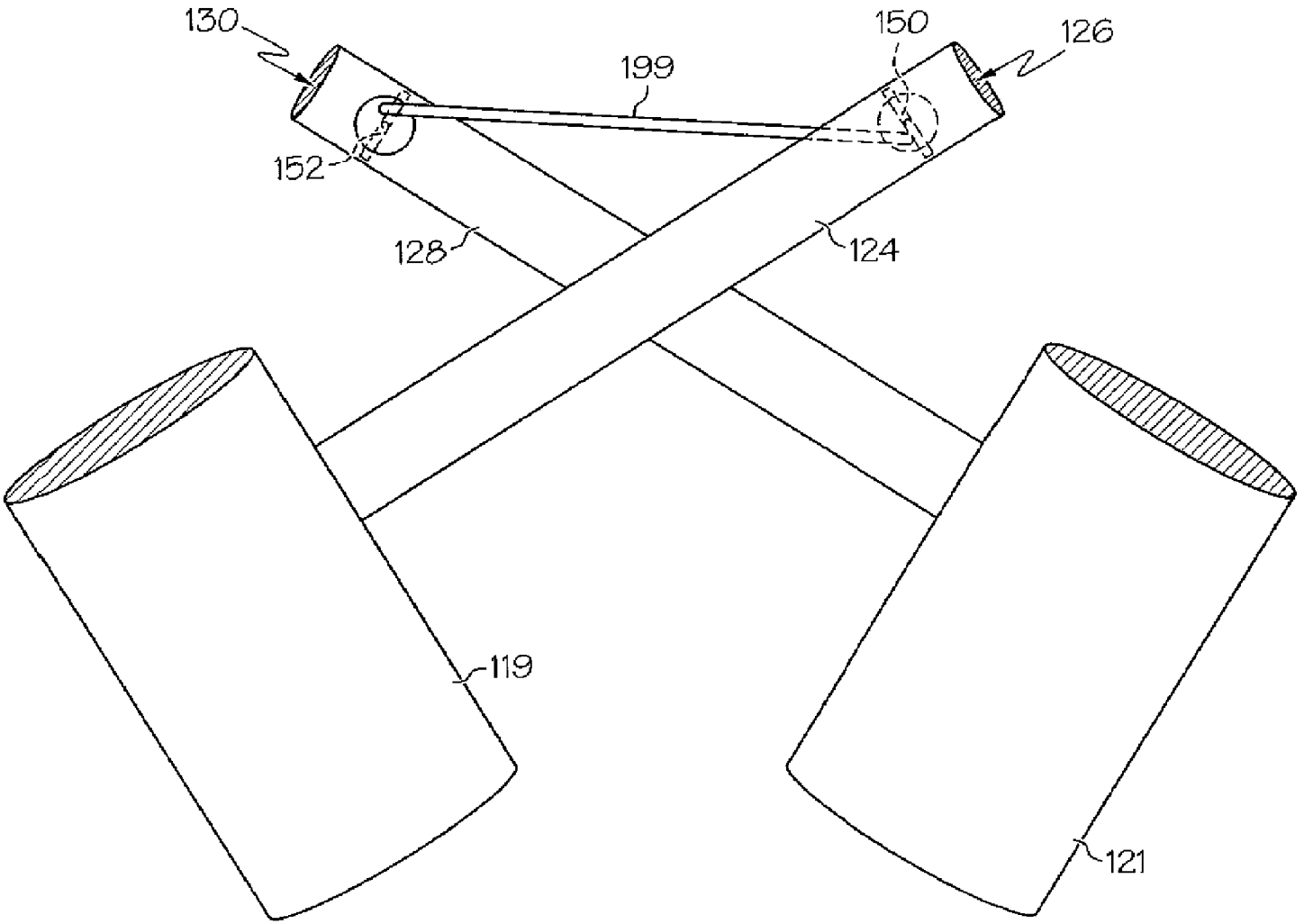
FIG. 6 (PRIOR ART)
FIG. 6 is a schematic view depicting a conventional throttle body arrangement for an engine.

It will be appreciated that the use of engaged gears to facilitate cooperative movement of valves in a throttle body may provide benefits over conventional throttle body arrangements. For example, by providing engaged gears (e.g., 70, 74 in FIG. 5) in place of a linkage member (e.g., 199 in FIG. 6), it will be appreciated that the number of movable components needed to facilitate cooperative movement of the valves of the throttle body can be minimized. By minimizing the number of components in this manner, it will be appreciated that a throttle body, in accordance with one embodiment, can be simpler, less expensive, smaller, lighter-weight, more reliable, and easier to assemble and service than conventional throttle bodies. For example, as compared with the throttle body 22 of FIG. 5, the linkage member 199 of the throttle body of FIG. 6 can be prone to breaking, and the pivotal attachments to the valves 150, 152 in FIG. 6 can be prone to seizing. Furthermore, through use of engaging gears as described above, it will be appreciated that the mechanical strain on the valves as a result of their pivotal attachment can be minimized (e.g., as compared to the arrangement of FIG. 6), thereby facilitating the use of lighter, less expensive materials (e.g., plastic, carbon fiber) during construction of the valves and other components of the throttle body. Also, by engaging the gears (e.g., 70, 74) and accordingly providing them proximally to one another, it will be appreciated that a common cover (e.g., 86 in FIG. 4) can be provided to facilitate enclosure of the gears to enhance aesthetic properties of the throttle body and to render the gears less prone to catch on passing debris, to catch on an operator's clothing, or to become seized from debris that may collect on the throttle body (e.g., mud, gravel) during vehicle operation.

A throttle body may comprise an actuation member which is configured to facilitate attachment of the throttle body to an actuator for facilitating control of the throttle body by the actuator. For example, in one embodiment, and as illustrated in FIGS. 3-5, the throttle body 22 may comprise a throttle wheel 80. In such an embodiment, at least one of a first cable 82 and a second cable 84 may be engaged with the throttle wheel 80. The first and second cables 82, 84 may each have an internal wire which is movable with respect to a stationary external sleeve (e.g., in a Bowden-type configuration). Movement of the first cable 82 and/or the second cable 84 may rotate the throttle wheel 80 to correspondingly pivot the first gear 70 and first valve 50 which in turn, can cause the corresponding pivoting of the second gear 74 and the second valve 52.

Although the throttle body is illustrated in FIGS. 3-5 and described above to comprise a throttle wheel 80, it will be appreciated that the throttle body may comprise any of a variety of alternative actuation members. For example, an actuation member may comprise a tab affixed to a gear. In another example, an actuation member may comprise a portion of a gear which defines an aperture. Moreover, although the first and second cables 82, 84 are shown to engage the throttle wheel 80, it will be appreciated that any of a variety of suitable actuators may be engaged with at least one of the gears of a throttle body. For example, the actuator may comprise a motor having an output shaft engaged with a first gear of a throttle body such that operation of the motor correspondingly operates both the first gear and a second gear engaged with the first gear. It will also be appreciated that an actuator may be connected to the gears of a throttle body in any of a variety of configurations or arrangements.

The actuator may be controlled to facilitate selective adjustment of the restriction of the passage of fluid through the first and second intake conduits. In one embodiment, the actuator (e.g., at least one of first cable 82 and second cable 84) may be attached to a throttle control handle 90 mounted on a handlebar 92 (shown in FIG. 1) of the motorcycle 10. Actuation of the throttle control handle 90 (e.g., with an operator's hand) may correspondingly control the first valve 50 and the second valve 52 during vehicle operation. In another embodiment, the actuator may be attached to an accelerator pedal mounted on the floor of a vehicle. Actuation of the accelerator pedal (e.g., with an operator's foot) may correspondingly control the first valve and the second valve during vehicle operation. It will be appreciated that control of an actuator may be achieved in any of a variety of alternative configurations or arrangements (e.g., which might involve drive-by-wire).

Though much of the foregoing discussion makes reference to the motorcycle 10 of FIG. 1, it will be appreciated that a throttle body as described above may be implemented in any of a variety of other saddle-type vehicles, such as, for example, an all terrain vehicle (ATV), a scooter, or a personal watercraft (PWC). It will also be appreciated that a throttle body can be provided upon any of a variety of other types of vehicles.

The foregoing description of embodiments and examples of the invention has been presented for purposes of illustration and description. It is not intended to be exhaustive or to limit the invention to the forms described. Numerous modifications are possible in light of the above teachings. Some of those modifications have been discussed and others will be understood by those skilled in the art. The embodiments were chosen and described in order to best illustrate the principles of the invention and various embodiments as are suited to the particular use contemplated. The scope of the invention is, of course, not limited to the examples or embodiments set forth herein, but can be employed in any number of applications and equivalent devices by those of ordinary skill in the art. Rather it is hereby intended the scope of the invention be defined by the claims appended hereto.

What is claimed is:

1. An engine comprising:

a first cylinder housing and a second cylinder housing arranged in a V-shape;

a first intake conduit in fluid communication with the first cylinder housing;

a second intake conduit in fluid communication with the second cylinder housing;

a first valve associated with the first intake conduit and movable to selectively adjust restriction of the first intake conduit to passage of fluid;

a first gear attached to the first valve;

a second valve associated with the second intake conduit and movable to selectively adjust restriction of the second intake conduit to passage of fluid;

a second gear attached to the second valve and engaged with the first gear such that the first gear and the second gear correspondingly rotate; and an actuation member engaged with at least one of the first gear and the second gear and configured to facilitate movement of each of the first valve and the second valve.

2. The engine of claim 1 wherein the first valve comprises a first butterfly valve and the second valve comprises a second butterfly valve.

3. The engine of claim 1 wherein the first intake conduit and the second intake conduit are arranged in a V-shape.

4. The engine of claim 1 wherein the engine comprises a V-twin engine.

5. The engine of claim 1 wherein the actuation member is configured for attachment to a Bowden-type cable.

6. The engine of claim 1 wherein the first valve is pivotable with respect to the first intake conduit and the second valve is pivotable with respect to the second intake conduit.

7. The engine of claim 1, wherein:

the first gear comprises a first set of involute teeth; and the second gear comprises a second set of involute teeth engaged with the first set of involute teeth.

8. A saddle-type vehicle comprising:

an engine comprising a first cylinder housing and a second cylinder housing;

a first intake conduit in fluid communication with the first cylinder housing;

a second intake conduit in fluid communication with the second cylinder housing;

a first valve associated with the first intake conduit and movable to selectively adjust restriction of the first intake conduit to passage of fluid;

a first gear attached to the first valve;

a second valve associated with the second intake conduit and movable to selectively adjust restriction of the second intake conduit to passage of fluid;

a second gear attached to the second valve and engaged with the first gear such that the first gear and the second gear correspondingly rotate; and an actuator engaged with at least one of the first gear and the second gear and configured to facilitate movement of each of the first valve and the second valve.

9. The saddle-type vehicle of claim 8 wherein the first valve comprises a first butterfly valve and the second valve comprises a second butterfly valve.

10. The saddle-type vehicle of claim 8 wherein the first intake conduit and the second intake conduit are arranged in a V-shape.

11. The saddle-type vehicle of claim 10 wherein the engine comprises a V-twin engine.

12. The saddle-type vehicle of claim 8 wherein the actuator comprises a Bowden-type cable.

13. The saddle-type vehicle of claim 12 further comprising a throttle control handle mounted on a handlebar of the saddle-type vehicle, wherein the Bowden-type cable is attached to the throttle control handle to facilitate control of the first valve and the second valve.

14. The saddle-type vehicle of claim 13 further comprising a seat, the seat being disposed at a location vertically above the engine.

15. The saddle-type vehicle of claim 14 comprising a motorcycle.

16. The saddle-type vehicle of claim 8 wherein the first valve is pivotable with respect to the first intake conduit and the second valve is pivotable with respect to the second intake conduit.

17. The saddle-type vehicle of claim 8, wherein:

the first gear comprises a first set of involute teeth; and the second gear comprises a second set of involute teeth engaged with the first set of involute teeth.

18. The saddle-type vehicle of claim 13, further comprising:

a throttle wheel; wherein the Bowden-type cable comprises a first Bowden-type cable;

the actuator further comprises a second Bowden-type cable, each of the first Bowden-type cable and the second Bowden-type cable being engaged with the throttle wheel; and movement of at least one of the first Bowden-type cable and the second Bowden-type cable causes the first valve to pivot relative to the first intake conduit and causes the second valve to pivot relative to the second intake conduit.

19. The saddle-type vehicle of claim 18, wherein:

the first valve comprises a first butterfly valve and the second valve comprises a second butterfly valve;

the first intake conduit and the second intake conduit are arranged in a V-shape;

the engine comprises a V-twin engine;

the first gear comprises a first set of involute teeth; and the second gear comprises a second set of involute teeth engaged with the first set of involute teeth.

20. A throttle body comprising:

a first intake conduit configured for placement in fluid communication with a first cylinder housing of an engine;

a second intake conduit configured for placement in fluid communication with a second cylinder housing of an engine wherein the first intake conduit and the second intake conduit are arranged in a V-shape;

a first valve associated with the first intake conduit and movable to selectively adjust restriction of the first intake conduit to passage of fluid;

a first gear attached to the first valve;

a second valve associated with the second intake conduit and movable to selectively adjust restriction of the second intake conduit to passage of fluid; and a second gear attached to the second valve and engaged with the first gear such that the first gear and the second gear correspondingly rotate.

21. The throttle body of claim 20 further comprising an actuation member engaged with at least one of the first gear and the second gear and configured to facilitate movement of each of the first valve and the second valve.

22. The throttle body of claim 21 wherein the actuation member is configured for attachment to a Bowden-type cable.

23. The throttle body of claim 20 wherein the first valve comprises a first butterfly valve and the second valve comprises a second butterfly valve.

24. The throttle body of claim 20 wherein the first valve is pivotable with respect to the first intake conduit and the second valve is pivotable with respect to the second intake conduit.

25. The throttle body of claim 20, wherein:

the first gear comprises a first set of involute teeth; and the second gear comprises a second set of involute teeth engaged with the first set of involute teeth.

* * * * *